United States Patent [19]

Schweizer

[11] 4,384,647

[45] May 24, 1983

[54] CONTAINER ASSEMBLY SUITABLE FOR STANDING ON A FLAT SURFACE

[76] Inventor: Eduard H. Schweizer, Marshall Point Rd., Cape Porpoise, Me. 04014

[21] Appl. No.: 178,821

[22] Filed: Aug. 18, 1980

[30] Foreign Application Priority Data

Aug. 22, 1979 [CH] Switzerland ..... 7651/79

[51] Int. Cl.[3] ..... B43M 17/00

[52] U.S. Cl. ..... 206/371; 206/214; 220/23.4; 211/60 R; D19/79

[58] Field of Search ..... 206/371, 214; 108/25, 108/26, 26.2; 211/11, 13, 60 R, 69.1, 69.2; 220/29.4, 23.8, 23.2, 23.4; D19/23, 35, 77, 78, 79, 80, 81, 93, 95

[56] References Cited

U.S. PATENT DOCUMENTS

| | | | |
|---|---|---|---|
| D. 147,265 | 8/1947 | Gardiner | D19/79 |
| 2,099,906 | 11/1937 | Reese et al. | 211/60 R X |
| 3,307,709 | 3/1967 | Hulterstrum | 220/23.4 X |
| 3,327,688 | 6/1967 | Smith | 206/214 |
| 4,176,743 | 12/1979 | Fitzpatrick | 206/214 |
| 4,258,847 | 3/1981 | Nierman | 220/23.4 X |

*Primary Examiner*—Steven M. Pollard

*Attorney, Agent, or Firm*—Cushman, Darby & Cushman

[57] ABSTRACT

A container assembly suitable for standing on a desk top or other flat surface to store office and other articles of daily use is built in a modular manner from individual structural elements arranged axially in series side by side. Each structural element consists of a prismatic body which has at least three longitudinal external walls and has a base, bounded by two longitudinal edges and two lateral edges, by means of which it stands on the desk top.

The longitudinal edges of the base and the longitudinal edges of the external walls run parallel to the central axis of the prismatic body. At least one of the longitudinal external walls of this body forms a front face which is inclined in a lectern-like manner in relation to the base, and the prismatic body has on both sides a side wall which in each case runs perpendicular to its central axis.

The prismatic bodies preferably have a hollow form and have an open front face into which are fitted, in a permanent or removable manner, a variety of inserts having holders or cavities for holding the articles concerned.

9 Claims, 11 Drawing Figures

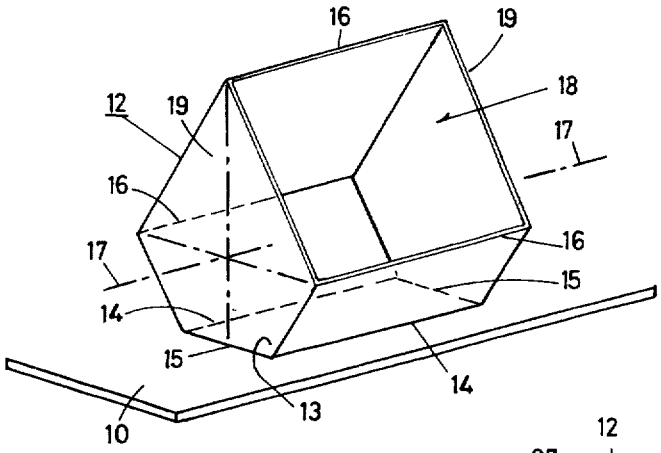
FIG. 1
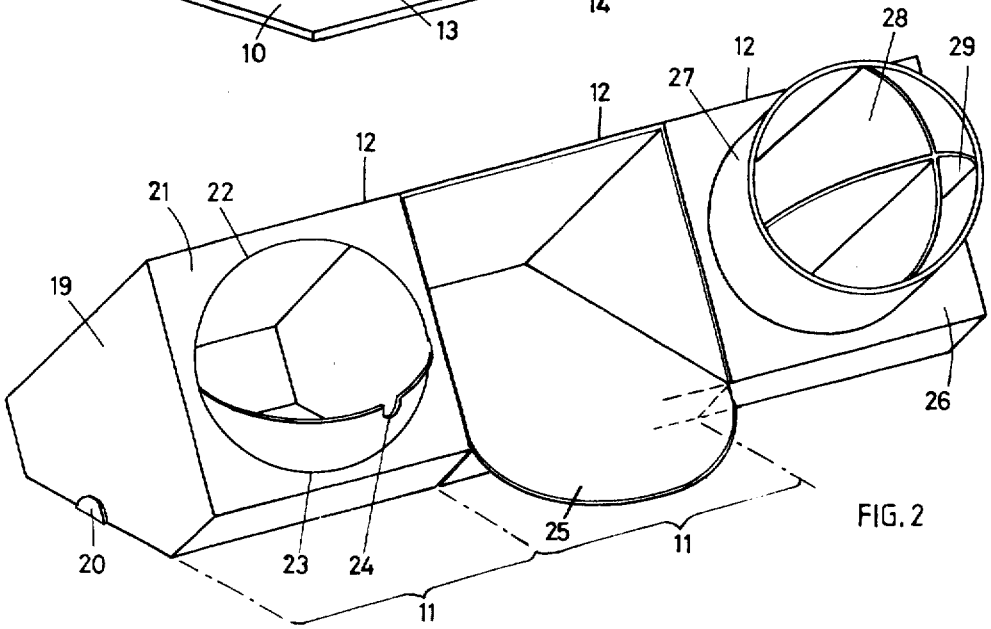
FIG. 2
FIG. 3
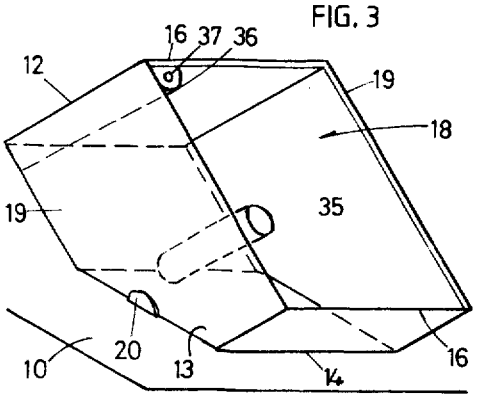
FIG. 4
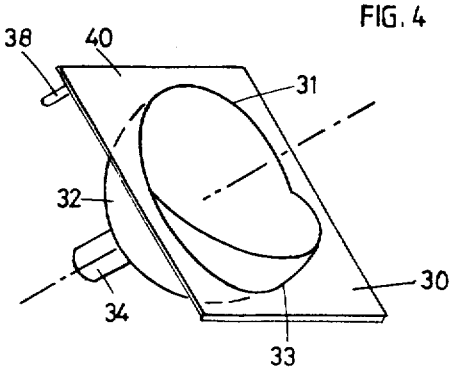

CONTAINER ASSEMBLY SUITABLE FOR STANDING ON A FLAT SURFACE

DESCRIPTION

The present invention relates to a container assembly suitable for standing on a flat surface, particularly on a table top, and equipped to store office articles and articles of daily use so that they are ready to hand.

Containers for storing office articles and articles of daily use so that they are ready to hand are already known in many embodiments, for example in the form of so-called desk fittings which have open trays for the storage of pencils and ball-point pens and have round or angular compartments for office articles such as paper clips, scribbling paper and the like. Since it is frequently undesirable to stand several such containers on a desk top, container assemblies in which the individual containers serving various purposes are arranged in part beside one another or behind one another and are firmly secured to one another, have already been suggested.

However, the known container assemblies in most cases have the disadvantage that they are not completely suitable for the very different requirements of users, since a certain standardisation, that is to say limitation to certain requirements, is necessary for the mass production of such container assemblies. Since aesthetic aspects are also important in the design of such container assemblies, for example as desk fittings, in order to ensure adequate sales of the relevant articles, taking these aspects into consideration frequently makes it impossible to take into consideration, simultaneously, all desires for storing the office articles and articles of daily use concerned, in an efficient manner and so that they are ready to hand.

The object of the present invention is to provide a container assembly for the abovementioned purposes and also for other purposes, which, on the one hand, substantially meets the aesthetic requirements and permits efficient and, therefore, attractively priced mass production, but which can also be adapted to the most diverse requirements of users.

According to the invention there is provided a container assembly suitable for standing on a desk top or other flat surface, for the storage of articles of daily use so that they are ready to hand, said container assembly comprising a plurality of individual structural elements arranged axially in series one beside the other, each structural element comprising a prismatic body which has at least three external walls extending in the longitudinal direction of the assembly and has a flat base which is bounded by two longitudinal edges and two lateral edges, the longitudinal edges of the base and the longitudinal edges of the external walls running parallel to the central axis of the prismatic body, at least one of the longitudinal external walls forming a front face which is inclined in a lectern-like manner to the base, and the prismatic body having on each side a side wall lying in a plane perpendicular to its central axis.

The invention will be further described, by way of example, with reference to the accompanying drawings, wherein:

FIG. 1 is a simplified perspective view of a prismatic hollow body, which serves as a structural element for a container assembly embodying the invention;

FIG. 2 is an illustrative perspective representation of a container assembly embodying the invention comprising three structural elements and using the prismatic body of FIG. 1;

FIGS. 3 and 4 are diagrammatic perspective representations together showing a structural element for use in forming a container assembly embodying the invention, FIG. 3 showing a hollow body similar to that of FIG. 1 and FIG. 4 showing an insert therefor;

Figure 5:
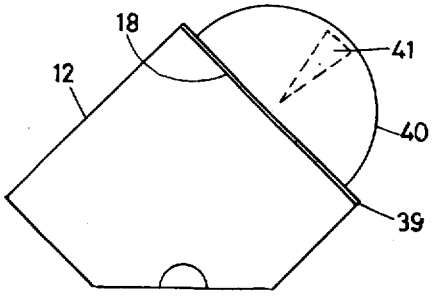
FIG. 5 is a diagrammatic side view of another embodiment of structural element.

FIGS. 1 and 2 show a preferred illustrative embodiment of the present container assembly. An essential factor of this container assembly is that it is built up from individual structural elements 11 which are arranged axially beside one another and which all have substantially the same shape and which constitute individual modules of the container assembly which is to be joined together. Each of these individual structural elements 11 consists of a prismatic body 12, which is shown in FIG. 1 and is constructed in the form of a hollow body in the present illustrative embodiment. The prismatic body 12 has a flat base 13 for being stood on a flat surface 10, which can, for example, be a desk top. As can be seen from FIG. 1, the central axis 17 of the prismatic body 12 runs parallel to the base 13, and therefore also parallel to the desk top 10. The base 13 is bounded by the two longitudinal edges 14, which also run parallel to the central axis 17, while the side edges 15 of this base 13 run perpendicular to the longitudinal edges 14. The longitudinal edges 16 of the prismatic body 12 are all also aligned parallel to the central axis 17 of the latter. At least one of the external walls of the prismatic body 12 forms a front face 18 which is inclined in lectern-like manner to the base 13 and which, in the case of the prismatic hollow body 12 of FIG. 1, is open and permits access to the interior space in the hollow body. The prismatic hollow body 12 is closed on both sides by side walls 19 which in each case run perpendicular to the central axis 17.

In the illustrative embodiment of the prismatic hollow body 12 shown in FIG. 1, the front face 18 which is inclined in a lectern-like manner forms an angle of 90° with the rear external wall adjacent to it, and the front face 18 and the adjacent rear external wall are each at an angle of 45° in respect to the plane of the base 13 and of the desk top 10.

The container assembly shown in FIG. 2 consists of structural elements 11, which in each case have an identical prismatic hollow body 12 and are arranged axially beside one another along their central axis 17. Connecting devices 20, of complementary shape, are provided at the side walls 19 of each of the prismatic bodies 12, so that the individual structural elements 11 can be secured to one another in such a way that the side walls 19 of adjacent structural elements facing one another bear on one another and are held in place in this position by means of the connecting devices 20, which match one another in a complementary manner. A container assembly thus consists, as shown in FIG. 2, of several structural elements 11 which are secured to one another and which have substantially the same shape and differ essentially only in the different construction of their front faces 18, which are inclined in a lectern-like manner.

FIG. 2 shows, as an example of a connecting device 20, a semi-circular disc which is attached to the side wall 19 and is spaced a small distance from the latter. The side face, of the next structural element 11, which faces the side face 19 when adjacent structural elements 11 are joined together, has, on its lower side edge 15, a cut-out which is adapted to receive the semi-circular disc 20, so that this structural element 11 can be mounted from above on the semi-circular disc 20, which then grips the side face 19 of the mounted structural element 11 at the back and retains the latter in this position. It is, of course, possible to have connecting devices of other types between adjacent structural elements 11, for example to have the lower side edges 15 of the side walls 19 which face one another of complementary shape. It is only necessary to ensure that the individual structural elements 11 of such a container assembly can at any time be secured to one another and once more separated from one another, entirely to suit the choice and the requirements of a particular user, without tools or other aids being necessary for this purpose.

A container assembly of the present design thus consists of individual structural elements 11 which have substantially the same shape and differ from one another only in the different construction of their front faces 18, which are inclined in a lectern-like manner. In the present illustrative embodiment according to FIG. 2, which uses a prismatic hollow body 12 according to FIG. 1, an insert for the open front face 18 is provided for each of the structural elements 11. The various inserts, which are described in greater detail below, can be fitted into the open front face 18 and can, as required, either be secured permanently in the hollow body 12 or be arranged for pulling or tilting out of the hollow body 12. Each insert can be adapted in an optimum manner to the end use of the particular structural element 11, which makes it possible for the bodies 12, which are identical for all the structural elements 11, to be manufactured by mass production. The appropriate inserts can then also be adjusted to requirements which only arise at a later time, which ensures that a container assembly of the present design cannot grow obsolete but can also be adapted to the changing requirements of users.

In the case of the container assembly according to FIG. 2, which consists of three structural elements 11, the left hand hollow body 12 has an insert which consists of a front panel 21 having a circular aperture 22 and of a spherical half-shell 23 which projects outwards and has a slit 24, suitable for the insertion and holding of a cigarette. The whole structural element 11 thus cnstitutes an ash tray, the insert being firmly mounted in the open front face 18, so that the whole structural element 11 can be withdrawn from the adjacent structural element and emptied by turning over, in order to empty this ash tray. If desired, the spherical half-shell 23 in FIG. 2 can, of course, be replaced by a spherical hollow body which closes the interior space of the body 12 and has only a sector-shaped aperture to the exterior, in which case this spherical hollow body can also be constructed so as to be removable from the aperture 22 of the front panel 21, in order that it may be emptied.

Beside the left hand structural element 11 there is a structural element 11 which fulfills other purposes and which consists of a hollow body 12 of the same shape and having an open front face, but which has, as insert, only a flat panel 25 which rests on the lower longitudinal edge 16 of the open front face 18 and extends into the hollow body 12. This panel is preferably secured permanently in the hollow body 12 and secured permanently at the longitudinal edges 16 which it touches and it can be used as a support for a stack of sheet-like articles, for example, scribbling paper, visiting cards and the like. In the illustrative embodiment shown in FIG. 2, the panel 25 runs approximately parallel to the base 13 of the hollow body 12, but alternatively it can be arranged to slope downwards and, for example, can rest on, or be secured to, the rear longitudinal edge 14 of the base 13.

The panel 25 is appropriately provided, as shown in FIG. 2, with a tongue which terminates in a semi-circular shape and projects out of the front face 18, in order to facilitate a user getting a good grip of an article which lies on it.

The structural element 11 located on the right hand side in the container assembly shown in FIG. 2 is intended for receiving and holding elongate articles, say pencils, ball-point pens and the like. This is made possible by means of an insert consisting of a front panel 26 which fits into the open front face 18 of the hollow body 12 concerned and which in turn carries a tubular component 27 which projects into the interior of the hollow body and also protrudes above the front panel 26. This tubular component 27 can be constructed in the form of a box and can therefore be provided with a base panel at its rear end, so that a large number of elongate articles can be stored, ready to hand, in this box. It is advantageous, as shown in FIG. 2, to subdivide the interior space of the tubular component 27 into several compartments by means of subdividing walls 28, 29. The walls 28, 29 shown can be constructed so as to be removable, so that it is possible to insert other desired or appropriate subdividing walls into the tubular component 27. The whole box-shaped component 27 can, of course, also be arranged in the front panel 26 so as to be removable from the hollow body 12. If desired, the tubular component 27 can also be provided with an external cap for closure.

FIGS. 3 and 4 show a further illustrative embodiment of a structural element 11 consisting of a prismatic hollow body 12 as shown in FIG. 3 and an insert, shown in FIG. 4, which can be inserted into and removed from the open front face 18 of the hollow body.

In this case the insert consists of a front panel 30 which fits into the open front face 18 and has a central aperture into which a part-spherical bowl 32 is firmly inserted. The lower domed wall 33 of this bowl projects somewhat from the bottom portions of the front panel 30. An extension 34 is attached centrally on the rear or reverse side of the spherical bowl 32 and fits into a tubular socket 35 which is rigidly secured in the interior space of the hollow body 12. If the insert according to FIG. 4 is fitted into the hollow body 12, the open front face 18 is closed by means of the front panel 30 of the insert and the bowl 32, 33 forms a container for holding small objects such as paper clips, drawing pins, pins and the like.

Yet another type of fastening for the insert according to FIG. 4, or the front panel 30 thereof, is shown in the hollow body 12 according to FIG. 3. In the four corners of the body leading to the open front face, it is possible, as shown at the top left hand corner only, to provide a quarter-circle cross-section rod 36 having a hole 37 extending therealong. The front panel 30 of the insert is then provided at its four corners with corresponding projecting pegs 38 which fit into the holes 37 of the rods 36, so that the insert is held in its place in the open front face 18, but can easily be taken out. It is, of course, possible to cement the pegs 38 into the holes 37, if the insert concerned is to be secured permanently in the hollow body 12. Instead of the pegs 38 indicated, it is also possible to provide corresponding through holes in the four corners of the front panel 30 and to fasten down the insert externally by means of four screws threaded into the holes 37.

If the forward projecting wall 33 of the spherical bowl 32 is continued further upwards, say until its edge is in a plane approximately parallel to the base 13 of the appropriate hollow body 12, an insert corresponding to FIG. 4 can also be used as an ash tray, as already explained above in the description of the left hand structural element 11 of FIG. 2. Such an embodiment of an insert intended as an ash tray enables it to be simply taken out of the hollow body 12 concerned, for purposes of cleaning.

FIG. 5 shows diagrammatically a further illustrative embodiment of a structural element of the present container assembly, consisting of a prismatic hollow body 12 and an insert which is fitted into this hollow body 12 through the open front face 18 and can be taken out again. This insert has a front panel 39 which fits into the open front face and to which is secured a hemispherical hollow body 40 in which a pencil sharpener 41 is installed. When this pencil sharpener 41 is used, the waste material falls into the internal space of the hollow body 12 and can easily be removed from the latter, by taking off the insert and separating the hollow body 12 from the particular container assembly and emptying it. It is, of course, possible to provide a superstructure 40 having a shape other than hemispherical. It is also possible to build the pencil sharpener 41 directly into the front panel 39 of the insert.

Figure 6:
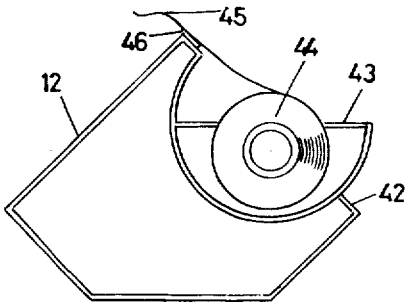
FIG. 6 is a diagrammatic cross-sectional view illustrating another structural element.

A further illustrative embodiment of a structural element 11 of the present container assembly is shown in cross-section in FIG. 6. Here the open front face 18 of the hollow body 12 contains an insert, the front panel 42 of which fills up this front face 18, is secured in a suitable manner (not shown) at the body 12 and carries a superstructure 43 for a replaceable roll 44 of adhesive tape 45. Furthermore, a cutter 46 is mounted on the upper longitudinal edge 16 of the front panel 42 in order to make it possible to tear off, in a known manner, a piece of the adhesive tape 45 which has been pulled off the roll 44. Depending on the width of the adhesive tape 45 provided, provision can also be made for the superstructure 43 to carry two different, separately replaceable rolls 44 of different adhesive tapes. In order to replace the rolls 44 easily, provision can be made for the insert to be easily extractable from, and reinsertable into, the hollow body 12.

Instead of a roll 44 of adhesive tape, it is also possible to mount on the superstructure 43 rolls of other tape-like articles, for example also postage stamps which have been wound up into the form of rolls and are connected by means of one of their edges, or labels which are connected, but can easily be separated from one another.

Figure 7:
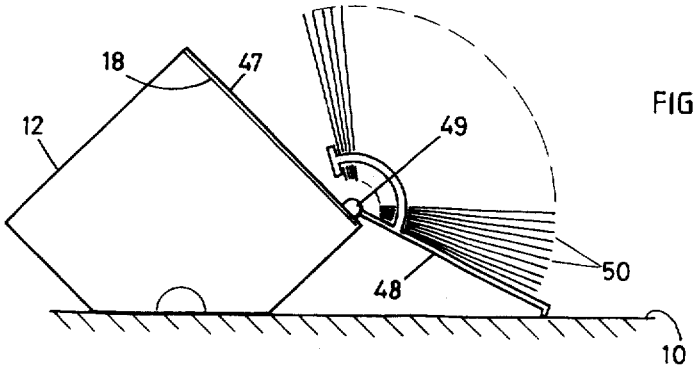
FIG. 7 is a diagrammatic side view of a further illustrative embodiment of a structural element.

It can also be desirable to equip the present container assembly with a structural element 11 containing a card-index, say a list of telephone numbers. FIG. 7 shows a diagram of such a structural element 11, consisting of a prismatic hollow body similar to FIG. 1, in the open front face 18 of which a withdrawable unit is provided, having a front panel 47 which here is appropriately firmly fastened to the hollow body 12. The front panel 47 contains a lid 48, which can be tilted outwards about the axis of rotation 49 and can be laid on the desk top 10. A suitable mechanism for holding a large number of replaceable card-index cards 50 is mounted on the reverse side of the lid 48. In the card-index cards 50 shown in FIG. 7, the captions are appropriately placed on the reverse side, that is to say on the side which is easily visible after lifting the lid. Instead of the shackle arrangement shown here, it is also possible to provide any other desired rotary or sliding mechanism for the individual card-index cards 50 on the inner side of the lid 48, so long as this mechanism ensures that the individual card-index cards 50 are easy to read and replace when the lid 48 is in the open position, but entirely disappear within the interior space of the hollow body 12 in the closed position of the lid 48.

Figure 8:
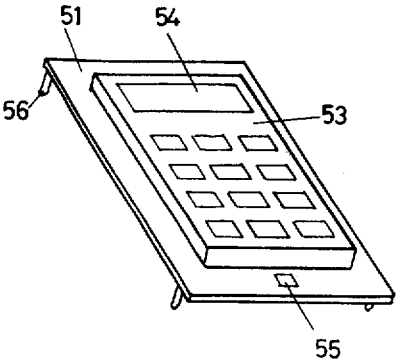
FIGS. 8 and 9 are in each case a diagrammatical perspective view of other illustrative embodiments of insert for use with a hollow body to form structural elements.

In a further illustrative embodiment of a structural element 11, the insert consists, as indicated in FIG. 8, of a front panel 51 which fits into the open front face 18 of the appropriate hollow body 12 and into which an electronic device 52 is fitted, which is preferably run from rechargeable batteries. This electronic device 53 can be provided with a digital indicator 54 and can, for example, be equipped as a calculator having an appropriate keyboard and can also contain an electronic clock, which can also be read via the digital indicator 54. If rechargeable batteries are provided to operate the electronic device 53, a plug-in connection 55 for charging the latter via a mains cable can also be mounted in the front panel 51. In order to secure this insert in the appropriate hollow body 12, the front panel 51 has, on each of its four corners, a peg-like prolongation 56 which fits into corresponding holes of lateral profile rods in the corners of the interior space of the hollow body 12, similar to the manner indicated in the left hand top corner of the hollow body 12 shown in FIG. 3.

Instead of the electronic calculator 53, it is also possible in a similar way to fit a miniature radio into the front panel 51 of such an insert, this radio also being run from replaceable batteries. The insert shown in FIG. 8 is appropriately inserted in the relevant hollow body 12 in such a way that it can be taken out at any time, in order for the batteries to be replaced in a simple manner when necessary.

Figure 9:
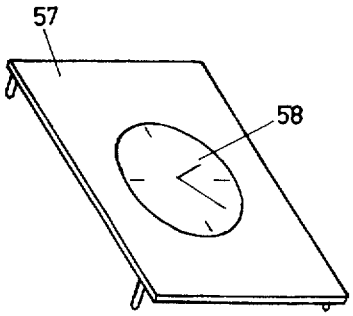

In another insert for a structural element 11, there is, as shown diagrammatically in FIG. 9, a front panel 57 which fits into the open front face 18 of the appropriate hollow body 12 and which can be secured in the latter in the same manner as described above by means of FIG. 8. In this case, a measuring device 58 having a clock face indicator, which can be a clock, preferably having an adjustable alarm device, or a thermometer, a barometer, a hygrometer or a similar instrument, is installed in the front panel 57.

The illustrative embodiments of structural elements 11 for the present container assembly which are described above by means of FIGS. 2 to 9 can, of course, be supplemented and arranged in a variety of ways. For example, an insert corresponding to FIG. 4 is also suitable for a sponge pad, inserted in the lower part of the interior space of the spherical bowl 32, such as is often used for moistening gummed edges in the routine of an office. In the container for paper slips shown in the central structural element 11 of the container assembly according to FIG. 2, it is also possible to provide a division into compartments on the flat panel 25, in order to store postage stamps or small objects, for example, in an orderly manner and so that they are ready to hand at any time. An insert according to FIG. 7, in which the front panel 47 has a lid 48 which can be tilted outwards, can also be used as a cigarette holder, if a suitably shaped drawer in which a packet of cigarettes can be inserted is mounted on the inner side of the lid 48. It is also possible, in the case of an insert according to FIG. 4, to fit into the front panel 30 a bowl 32 which does not have a spherical shape but has another shape and which is designed to hold the bowl of a tobacco pipe.

The individual structural elements 11, such as are described above by means of FIGS. 2 to 9, differ from one another only in the different shape of the inserts. Such an embodiment of the present container assembly then has the longitudinal external walls of the individual bodies 12 mutually adjoining, which is frequently desirable for aesthetic reasons. However, in some illustrative embodiments of a structural element 11, it is also possible to utilise the free space of the external surface which adjoins the upper longitudinal edge 16 of the open front face 18 and which is inclined to the rear, as shown, for example, in FIG. 10. In this case a flat plate 59 having an overlapping collar 60 is slipped onto the upper edge of this rear external wall and, together with the transverse walls 61 which are fastened to it, forms a set of pigeonholes to enable the note sheets 62 lying on the horizontal panel 25 to be filed, after use, in various compartments of the pigeonholes. Instead of the transverse walls 61, the flat plate 59 can, however, also carry one or more holders 63 for ball-point pens and the like, as indicated diagrammatically in FIG. 11. As is customary, the holders 63 can be secured to the plate 59 in a movable manner through a ball and socket joint 64.

Figure 10:
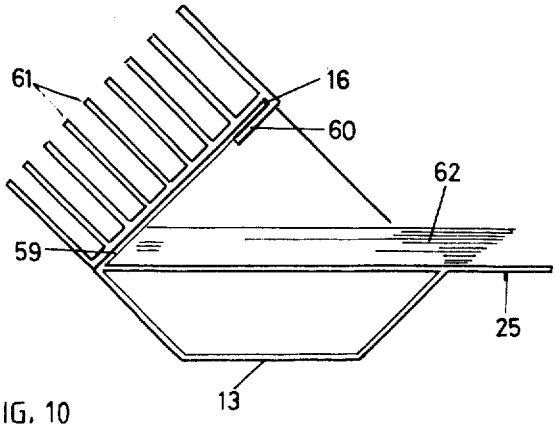
FIGS. 10 and 11 are in each case a side view of an illustrative embodiment of a superstructure which may be applied to a longitudinal external wall of the hollow prismatic body.
Figure 11:
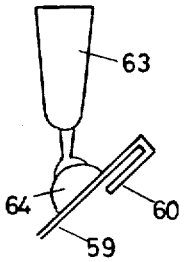
Figure 12:
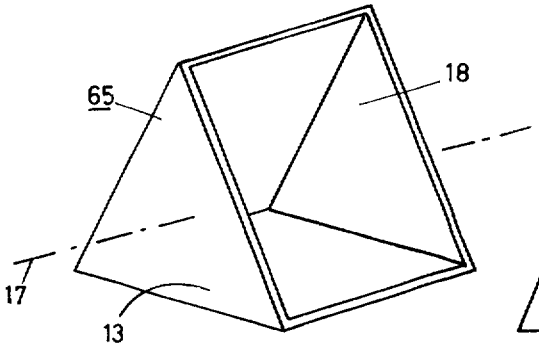
FIGS. 12 and 13 are perspective and side representations respectively, of another form of prismatic hollow body which may be used for structural elements in a container assembly according to the invention.
Figure 13:
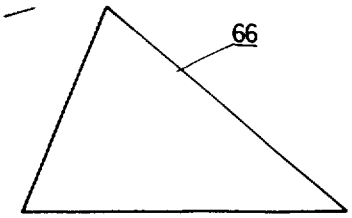

It is also possible, of course, to mount a set of pigeonholes for notes according to FIG. 10 or a holder according to FIG. 11 directly on the front panel for an insert into the hollow body 12 of a structural element.

In the illustrative embodiments described above, prismatic bodies are each shown with sharp longitudinal edges 16. If desired, it is, of course, possible to use prismatic bodies which have rounded off longitudinal edges. Furthermore, the container assembly can also consist of prismatic bodies 12 which have differing axial lengths. For example, one of these bodies can have an axial length three times or several times that of the remaining bodies and the internal space accessible through the open front face can be used for the storage of pencils, ball-point pens and similar writing equipment in a lying position.

I claim:

1. A container assembly suitable for standing on a desk top or other flat surface for the storage of articles of daily use so that they are ready to hand, characterized by:

a modular assembly of individual structural elements arranged axially one beside another, said elements being joinable to and detachable from each other in the direction of their central axis and constituting when joined together a longitudinal prismatic assembly;

said individual elements having identical external dimensions in directions normal to said central axis and each comprising a hollow prismatic body having a rectangular base provided with two longitudinal edges and two lateral edges and being closed on both sides by side walls normal to said central axis and of pentagonal shape with said base lateral edges as their bottom edges;

each of said bodies comprising three outer walls of rectangular shape extending parallel to said central axis and to said base longitudinal edges and being provided with an at least partially open front face which is inclined in a lectern-like manner to said base and designed for acceptance of inserts adapted to the articles; and an insert in the front face of at least one of said bodies comprising a front panel which has an aperture and a tray-like component which projects forward, partially closing said aperture.

2. A container assembly suitable for standing on a desk top or other flat surface for the storage of articles of daily use so that they are ready to hand, characterized by:

a modular assembly of individual structural elements arranged axially one beside another, said elements being joinable to and detachable from each other in the direction of their central axis and constituting when joined together a longitudinal prismatic assembly;

said individual element having identical external dimensions in directions normal to said central axis and each comprising a hollow prismatic body having a rectangular base provided with two longitudinal edges and two lateral edges and being closed on both sides by side walls normal to said central axis and of pentagonal shape with said base lateral edges as their bottom edges;

each of said bodies comprising three outer walls of rectangular shape extending parallel to said central axis and to said base longitudinal edges and being provided with an at least partialliy open front face which is inclined in a lectern-like manner to said base and designed for acceptance of inserts adapted to the articles; and an insert in the front face of at least one of said bodies comprising a flat panel which rests on the lower longitudinal edge of said front face and extends into the interior of said body to form a support for a stack of sheet-like articles.

3. A container assembly suitable for standing on a desk top or other flat surface for the storage of articles of daily use so that they are ready to hand, characterized by:

a modular assembly of individual structural elements arranged axially one beside another, said elements being joinable to and detachable from each other in the direction of their central axis and constituting when joined together a longitudinal prismatic assembly;

said individual elements having identical external dimensions in directions normal to said central axis and each comprising a hollow prismatic body having a rectangular base provided with two longitudinal edges and two lateral edges and being closed on both sides by side walls normal to said central axis and of pentagonal shape with said base lateral edges at their bottom edges;

each of said bodies comprising three outer walls of rectangular shape extending parallel to said central axis and to said base longitudinal edges and being provided with an at least partially open front face which is inclined in a lectern-like manner to said base and designed for acceptance of inserts adapted to the articles; and an insert in the front face of at least one of said bodies comprising a front panel having an aperture and a spherical bowl which is fastened to said front panel and has a spherically domed partition, the lower part of which projects beyond said front panel, the cavity bounded by said bowl and said partition forming a container for holding small objects.

4. A container assembly suitable for standing on a desk top or other flat surface for the storage of articles of daily use to that they are ready to hand, characterized by:

a modular assembly of individual structural elements arranged axially one beside another, and elements being joinable to and detachable from each other in the direction of their central axis and constituting when joined together a longitudinal prismatic assembly;

said individual elements having identical external dimensions in directions normal to said central axis and each comprising a hollow prismatic body having a rectangular base provided with two longitudinal edges and two lateral edges and being closed on both sides by side walls normal to said central axis and of pentagonal shape with said base lateral edges as their bottom edges;

each of said bodies comprising three outer walls of rectangular shape extending parallel to said central axis and to said base longitudinal edges and being provided with an at least partially open front face which is inclined in a lectern-like manner to said base and designed for acceptance of inserts adapted to the articles; and an insert in the front face of at least one of said bodies comprising a front panel having a mounting in which a pencil sharpener is located.

5. A container assembly suitable for standing on a desk top or other flat surface for the storage of articles of daily use so that they are ready to hand, characterized by:

a modular assembly of individual structural elements arranged axially one beside another, said elements being joinable to and detachable from each other in the direction of their central axis and constituting when joined together a longitudinal prismatic assembly;

said individual elements having identical external dimensions in directions normal to said central axis and each comprising a hollow prismatic body having a rectangular base provided with two longitudinal edges and two lateral edges and being closed on both sides by side walls normal to said central axis and of pentagonal shape with said base lateral edges as their bottom edges;

each of said bodies comprising three outer walls of rectangular shape extending parallel to said central axis and to said base longitudinal edges and being provided with an at least partially open front face which is inclined in a lectern-like manner to said base and designed for acceptance of inserts adapted to the articles; and an insert in the front face of at least one of said bodies comprising a front panel having a mounting which is adapted to carry at least one replaceable roll of a tape-like article which can be removed therefrom.

6. A container assembly suitable for standing on a desk top or other flat surface for the storage of articles of daily use so that they are ready to hand, characterized by:

a modular assembly of individual structural elements arranged axially one beside another, said elements being joinable to and detachable from each other in the direction of their central axis and constituting when joined together a longitudinal prismatic assembly;

said individual elements having identical external dimensions in directions normal to said central axis and each comprising a hollow prismatic body having a rectangular base provided with two longitudinal edges and two lateral edges and being closed on both sides by side walls normal to said central axis and of pentagonal shape with said base lateral edges as their bottom edges;

each of said bodies comprising three outer walls of rectangular shape extending parallel to said central axis and to said base longitudinal edges and being provided with an at least partially open front face which is inclined in a lectern-like manner to said base and designed for acceptance of inserts adapted to the articles; and an insert for the front face of at least one of said bodies comprising a front panel having an openable lid which carries on its inner side a device for holding and displaying replaceable index cards.

7. A container assembly suitable for standing on a desk top or other flat surface for the storage of articles of daily use so that they are ready to hand, characterized by:

a modular assembly of individual structural elements arranged axially one beside another, said elements being joinable to and detachable from each other in the direction of their central axis and constituting when joined together a longitudinal prismatic assembly;

said individual elements having identical external dimensions in directions normal to said central axis and each comprising a hollow prismatic body having a rectangular base provided with two longitudinal edges and two lateral edges and being closed on both sides by side walls normal to said central axis and of pentagonal shape with said base lateral edges as their bottom edges;

each of said bodies comprising three outer walls of rectangular shape extending parallel to said central axis and to said base longitudinal edges and being provided with an at least partially open front face which is inclined in a lectern-like manner to said base and designed for acceptance of inserts adapted to the articles; and an insert for the front face of at least one of said bodies comprising a front panel having a battery operable electronic device installed therein.

8. A container assembly suitable for standing on a desk top or other flat surface for the storage of articles of daily use so that they are ready to hand, characterized by:

a modular assembly of individual structural elements arranged axially one beside another, said elements being joinable to and detachable from each other in the direction of their central axis and constituting when joined together a longitudinal prismatic assembly;

said individual elements having identical external dimensions in directions normal to said central axis and each comprising a hollow prismatic body having a rectangular base provided with two longitudinal edges and two lateral edges and being closed on both sides by side walls normal to lateral edges as their bottom edges;

each of said bodies comprising three outer walls of rectangular shape extending parallel to said central axis and to said base longitudinal edges and being provided with an at least partially open front face which is inclined in a lectern-like manner to said base and designed for acceptance of inserts adapted to the articles; and an insert for the front face of at least one of said bodies comprising a front panel which has a measuring device installed therein.

9. A container assembly suitable for standing on a desk top or other flat surface for the storage of articles of daily use so that they are ready to hand, characterized by:

a modular assembly of individual structural elements arranged axially one beside another, said elements being joinable to and detachable from each other in the direction of their central axis and constituting when joined together a longitudinal prismatic assembly;

said individual elements having identical external dimensions in directions normal to said central axis and each comprising a hollow prismatic body having a rectangular base provided with two longitudinal edges and two lateral edges and being closed on both sides by side walls normal to said central axis and of pentagonal shape with said base lateral edges as their bottom edges;

each of said bodies comprising three outer walls of rectangular shape extending parallel to said central axis and to said base longitudinal edges and being provided with an at least partially open front face which is inclined in a lectern-like manner to said base and designed for acceptance of inserts adapted to the articles; and an insert for the front face of at least one of said bodies comprising a flat plate which rests on the upper rear wall and on the upper longitudinal edge of the open front face, and a device carried by the flat plate for holding articles to be stored.

* * * * *